US011534814B2

(12) United States Patent
Yamamoto

(10) Patent No.: US 11,534,814 B2
(45) Date of Patent: Dec. 27, 2022

(54) MANUFACTURING DEVICE FOR BENT PIPE AND METHOD OF MANUFACTURING BENT PIPE

(71) Applicant: FUTABA INDUSTRIAL CO., LTD., Okazaki (JP)

(72) Inventor: Koichiro Yamamoto, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 0 days.

(21) Appl. No.: 17/522,166

(22) Filed: Nov. 9, 2021

(65) Prior Publication Data

US 2022/0152681 A1 May 19, 2022

(30) Foreign Application Priority Data

Nov. 16, 2020 (JP) ..... JP2020-190330

(51) Int. Cl.
*B21D 9/07* (2006.01)
*B21D 9/04* (2006.01)

(52) U.S. Cl.
CPC ..... *B21D 9/073* (2013.01); *B21D 9/04* (2013.01)

(58) Field of Classification Search
CPC ... B21D 9/01; B21D 9/03; B21D 9/04; B21D 9/05; B21D 9/07; B21D 9/073; B21D 9/16; B21D 7/024; B21D 7/03; B21D 7/04
See application file for complete search history.

(56) References Cited

U.S. PATENT DOCUMENTS 5,749,255 A 5/1998 Arai
5,937,686 A * 8/1999 Arai ..... B21D 9/073 72/370.01
7,131,313 B2 * 11/2006 Nakazato ..... B21D 9/073 72/149

FOREIGN PATENT DOCUMENTS

JP H09155456 A 6/1997

* cited by examiner

*Primary Examiner* — Teresa M Ekiert
(74) *Attorney, Agent, or Firm* — Withrow & Terranova, P.L.L.C.; Vincent K. Gustafson

(57) ABSTRACT

One aspect of the present disclosure is a manufacturing device for a bent pipe by which the bent pipe is obtained by bending a double pipe. The manufacturing device for a bent pipe includes an inner core metal, an intermediate core metal, a bending mold, and a controller. The controller executes a first bending process, a second bending process, and a re-bending process. In the first bending process, a first pipe and a second pipe are bend in a first direction in a first area. In the second bending process, the first pipe and the second pipe are bent in a second direction in a second area. The second area has more distance from a coupling portion than the first area does. In the re-bending process, the second pipe is bent in the same direction as the second direction in the second area.

7 Claims, 14 Drawing Sheets

MANUFACTURING DEVICE FOR BENT PIPE AND METHOD OF MANUFACTURING BENT PIPE

CROSS-REFERENCE TO RELATED APPLICATIONS

This application claims the benefit of Japanese Patent Application No. 2020-190330 filed on Nov. 16, 2020 with the Japan Patent Office, the entire disclosure of which is incorporated herein by reference.

BACKGROUND

The present disclosure relates to a manufacturing device for a bent pipe and a method of manufacturing a bent pipe.

There has been known a method of bending a double pipe in a specified direction at multiple points by externally pressing a bending mold against the double pipe containing a core metal (that is, a mandrel) therein and moving the bending mold (Japanese Unexamined Patent Application Publication No. H9-155456).

SUMMARY

A bending process of a double pipe is applied to a portion of the double pipe in which a core metal is placed between an inner pipe and an outer pipe. Thus, a gap between the inner pipe and the outer pipe is maintained. However, if the bending process is applied to an area of the double pipe distanced from a coupling portion between the inner pipe and the outer pipe, the inner pipe is bent while extending in an axial direction thereof with respect to the outer pipe when the core metal is pulled or being pulled. Consequently, bending of the inner pipe and bending of the outer tube do not coincide with each other, which reduces the gap between the inner pipe and the outer pipe.

In one aspect of the present disclosure, it is desirable to provide a manufacturing device for a bent pipe that can bend a double pipe multiple times while maintaining a gap between an inner pipe and an outer pipe.

One aspect of the present disclosure is a manufacturing device for a bent pipe by which the bent pipe is obtained by bending a double pipe provided with a first pipe, a second pipe containing the first pipe therein, and a coupling portion coupling the first pipe and the second pipe to each other. The manufacturing device for a bent pipe comprises an inner core metal configured to be placed inside the first pipe, an intermediate core metal configured to be placed between the first pipe and the second pipe, a bending mold configured to bend the double pipe, and a controller.

The controller is configured to execute a first bending process, a second bending process, and a re-bending process. In the first bending process, the first pipe and the second pipe are bent in a first direction with the bending mold in a first area of the double pipe where the inner core metal and the intermediate core metal are placed. In the second bending process, the first pipe and the second pipe are bent in a second direction with the bending mold after the first bending process. The second bending process is applied to a second area of the double pipe where the inner core metal and the intermediate core metal are placed. The second area has more distance from the coupling portion than the first area does. In the re-bending process, the second pipe is bent in the same direction as the second direction in the second area after the second bending process.

According to the above configuration, in the second area distanced from the coupling portion, the second pipe is re-bent so as to follow bending of the first pipe caused due to the core metals being pulled out or having pulled out after the second bending process. Thus, it is possible to bend the double pipe multiple times while maintaining a gap between the first pipe and the second pipe.

In one aspect of the present disclosure, the controller may be configured to execute a supplemental re-bending process in which the second pipe is bent in the same direction as the first direction in the first area after the first bending process. According to this configuration, it is possible to compensate for reduction of the gap between the first pipe and the second pipe in the first area.

In one aspect of the present disclosure, the controller may be configured to execute the supplemental re-bending process after the second bending process. According to this configuration, it is possible to execute the re-bending process, with the double pipe being placed in a specific orientation, after completion of the first bending process and the bending second process. This consequently facilitates compensation for the gap between the first pipe and the second pipe.

In one aspect of the present disclosure, the manufacturing device for a bent pipe may further comprise a re-bending mold configured to rotate the second pipe about a fulcrum included in the second area, to thereby bend the second pipe. The controller may be configured to bend the second pipe with the re-bending mold in the re-bending process. According to this configuration, the second pipe is re-bent in a portion thereof corresponding to a portion of the first pipe that is or has been greatly deformed. Accordingly, it is possible to efficiently leave the gap between the first pipe and the second pipe.

In one aspect of the present disclosure, the controller may be configured to execute the supplemental re-bending process with the bending mold before the second bending process. Such a configuration enables an execution of the supplemental re-bending of the double pipe with the double pipe placed in the bending mold. Accordingly, the manufacturing process of the bent pipe is reduced.

In one aspect of the present disclosure, the first direction and the second direction may be the same direction. According to this configuration, in the double pipe to be bent multiple times in the same direction, it is possible to efficiently compensate for reduction of the gap between the first pipe and the second pipe.

Another aspect of the present disclosure is a method of manufacturing a bent pipe by which the bent pipe is obtained by bending a double pipe provided with a first pipe, a second pipe containing the first pipe therein, and a coupling portion coupling the first pipe and the second pipe to each other.

The method of manufacturing a bent pipe comprises: placing an inner core metal inside the first pipe and placing an intermediate core metal between the first pipe and the second pipe; bending the first pipe and the second pipe in a first direction with a bending mold in a first area of the double pipe where the inner core metal and the intermediate core metal are placed; bending the first pipe and the second pipe in a second direction with the bending mold after the bending in the first direction, the bending in the second direction being applied to a second area of the double pipe where the inner core metal and the intermediate core metal are placed, the second area having more distance from the coupling portion than the first area does; and re-bending the second pipe in the same direction as the second direction in the second area after the bending in the second direction.

According to the above configuration, in the second area distanced from the coupling portion, the second pipe is re-bent so as to follow bending of the first pipe caused due to the core metals being pulled out or having been pulled out after bending of the double pipe in the second direction. Accordingly, it is possible to bend the double pipe multiple times while maintaining the gap between the first pipe and the second pipe.

BRIEF DESCRIPTION OF THE DRAWINGS

Example embodiments of the present disclosure will be described hereinafter with reference to the accompanying drawings, in which.

DETAILED DESCRIPTION OF EXEMPLARY EMBODIMENTS

1. First Embodiment

[1-1. Configuration]

Figure 1:
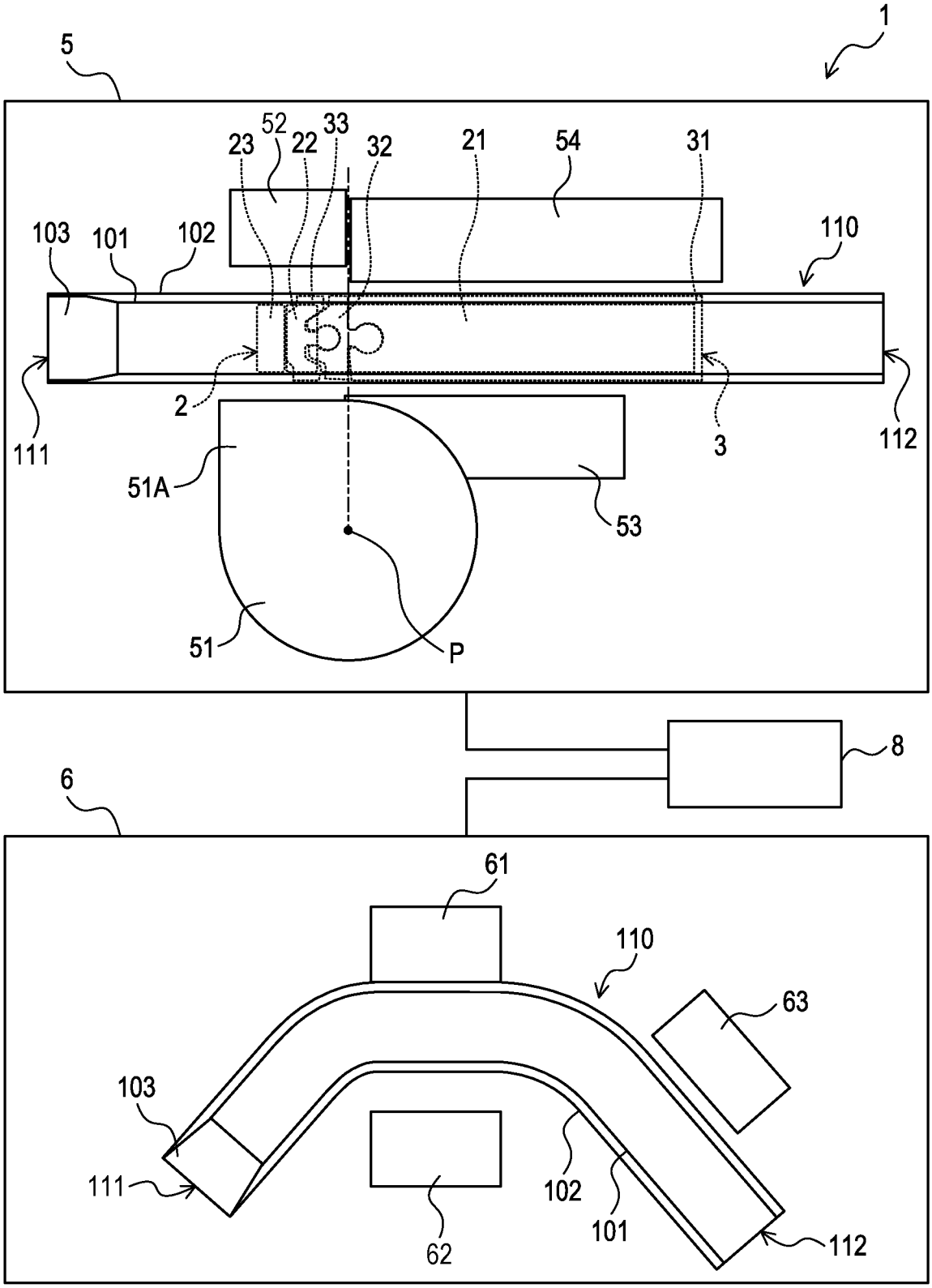
FIG. 1 is a schematic diagram of a manufacturing device for a bent pipe according to an embodiment.

A device 1 for manufacturing a bent pipe (hereinafter, simply referred to as "manufacturing device 1") shown in FIG. 1 is a device for obtaining a bent pipe by bending a straight pipe.

The manufacturing device 1 of the present embodiment manufactures a bent pipe from a double pipe 110 that comprises a first pipe 101 and a second pipe 102. The second pipe 102 is placed to enclose an outer-circumferential surface of the first pipe 101. In other words, the second pipe 102 contains therein the first pipe 101. FIG. 1 and other figures show the double pipe 110 in a cross-section.

The double pipe 110 comprises a coupling portion 103 coupling the first pipe 101 and the second pipe 102 to each other. The coupling portion 103 is provided to a first end 111 of the double pipe 110. At a second end 112 of the double pipe 110 situated opposite to the first end 111, the first pipe 101 and the second pipe 102 are not joined to each other.

Specifically, the first pipe 101 has a diameter extending so as to contact an inner-circumferential surface of the second pipe 102. That is, the first pipe 101 includes an end, which is a part of the coupling portion 103. Furthermore, the first pipe 101 and the second pipe 102 are joined to each other by spot welding at the first end 111. A method of joining the first pipe 101 and the second pipe 102 to each other is not limited to welding.

The first pipe 101 and the second pipe 102 each have a circular (i.e., perfect circle or oval) outer shape in a cross-section perpendicular to respective central axes of the first pipe 101 and the second pipe 102. In the present embodiment, the central axis of the first pipe 101 and the central axis of the second pipe 102 coincide with each other; however, the respective central axes of the first pipe 101 and the second pipe 102 may not necessarily coincide with each other.

The manufacturing device 1 simultaneously bends the first pipe 101 and the second pipe 102 while leaving a gap therebetween, to thereby obtain the bent double pipe 110 as the bent pipe.

The manufacturing device 1 comprises an inner core metal 2, an intermediate core metal 3, a bending mold 5, a re-bending mold 6, and a controller 8.

<Inner Core Metal>

Figure 2A:
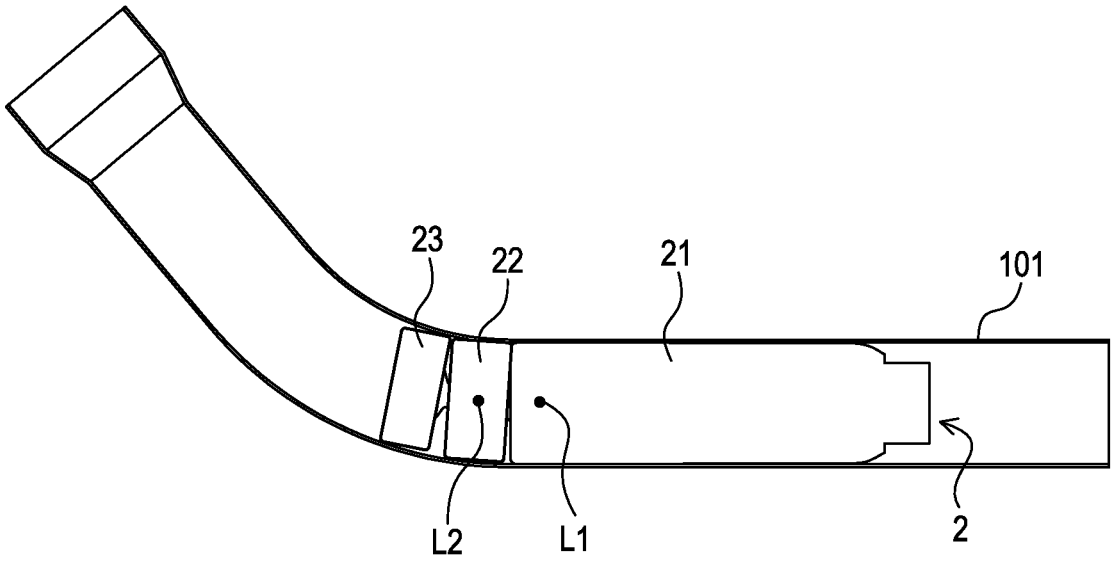
FIG. 2A is a schematic side view of an inner core metal in the manufacturing device for a bent pipe of FIG. 1.

As shown in FIG. 2A, the inner core metal 2 is configured to be placed inside the first pipe 101. The inner core metal 2 includes an inner core metal main body 21, a first inner movable portion 22, and a second inner movable portion 23.

(Inner Core Metal Main Body)

The inner core metal main body 21 comprises a cylindrical or columnar member. The inner core metal main body 21 is placed in a straight portion (in other words, a portion that is not bent) of the double pipe 110.

The outer diameter of the inner core metal main body 21 is constant along an axial direction thereof. The outer diameter of the inner core metal main body 21 is substantially equal to the inner diameter of the first pipe 101. A length of the inner core metal main body 21 along the axial direction is longer than respective lengths of the first inner movable portion 22 and the second inner movable portion 23 along the axial direction.

(First Inner Movable Portion)

The first inner movable portion 22 comprises a cylindrical or columnar member that is coupled to one end of the inner core metal main body 21 in the axial direction.

The first inner movable portion 22 pivots with respect to the inner core metal main body 21 about a first pivot axis L1 that is perpendicular to the central axis of the inner core metal main body 21. The first pivot axis L1 runs through an intersection between a straight line including the central axis of the inner core metal main body 21 and a straight line including the central axis of the first inner movable portion 22.

(Second Inner Movable Portion)

The second inner movable portion 23 comprises a cylindrical or columnar member that is coupled to the first inner movable portion 22 on an opposite side to the inner core metal main body 21 across the first inner movable portion 22.

The second inner movable portion 23 pivots with respect to the first inner movable portion 22 about a second pivot axis L2 that is parallel to the first pivot axis L1 of the first inner movable portion 22. The second pivot axis L2 runs through an intersection between the straight line including the central axis of the first inner movable portion 22 and a straight line including the central axis of the second inner movable portion 23.

<Intermediate Core Metal>

The intermediate core metal 3 shown in FIG. 1 is configured to be placed between the first pipe 101 and the second pipe 102.

The intermediate core metal 3 is placed in a bending portion of the double pipe 110 so as to interpose the first pipe 101 between the intermediate core metal 3 and the inner core metal 2 in a radial direction of the first pipe 101. Furthermore, the intermediate core metal 3 is interposed between the first pipe 101 and the second pipe 102 in the radial direction of the first pipe 101.

Figure 2B:
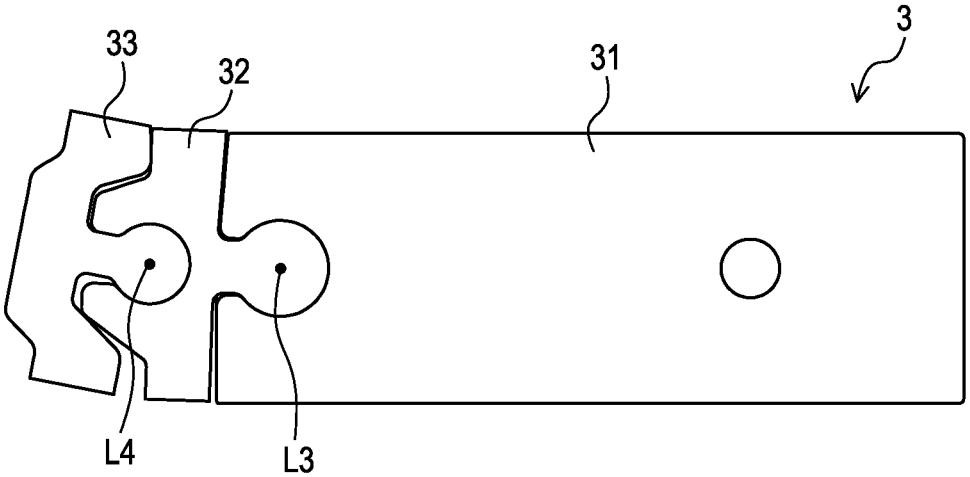
FIG. 2B is a schematic side view of an intermediate core metal in the manufacturing device for a bent pipe of FIG. 1.

As shown in FIG. 2B, the intermediate core metal 3 includes an intermediate core metal main body 31, a first intermediate movable portion 32, and a second intermediate movable portion 33.

(Intermediate Core Metal Main Body)

The intermediate core metal main body 31 comprises a cylindrical member. The intermediate core metal main body 31 is placed in the straight portion of the double pipe 110.

The inner diameter and the outer diameter of the intermediate core metal main body 31 are constant along an axial direction thereof. The inner diameter of the intermediate core metal main body 31 is substantially equal to the outer diameter of the first pipe 101. The outer diameter of the intermediate core metal main body 31 is substantially equal to the inner diameter of the second pipe 102. A length of the intermediate core metal main body 31 along the axial direction is longer than respective lengths of the first intermediate movable portion 32 and the second intermediate movable portion 33 along the axial direction.

(First Intermediate Movable Portion)

The first intermediate movable portion 32 comprises a cylindrical member that is directly coupled to one end of the intermediate core metal main body 31 in the axial direction.

The first intermediate movable portion 32 pivots with respect to the intermediate core metal main body 31 about a third pivot axis L3 that is perpendicular to the central axis of the intermediate core metal main body 31. The third pivot axis L3 runs through an intersection between a straight line including the central axis of the intermediate core metal main body 31 and a straight line including the central axis of the first intermediate movable portion 32. Furthermore, the third pivot axis L3 is parallel to the first pivot axis L1.

(Second Intermediate Movable Portion)

The second intermediate movable portion 33 comprises a cylindrical member that is directly coupled to the first intermediate movable portion 32 on an opposite side to the intermediate core metal main body 31 across the first intermediate movable portion 32.

The second intermediate movable portion 33 pivots with respect to the first intermediate movable portion 32 about a fourth pivot axis L4 that is parallel to the third pivot axis L3 of the first intermediate movable portion 32. The fourth pivot axis L4 runs through an intersection between the straight line including the central axis of the first intermediate movable portion 32 and a straight line including the central axis of the second intermediate movable portion 33.

<Bending Mold>

The bending mold 5 shown in FIG. 1 is configured to bend the double pipe 110 in an area of the double pipe 110 where the inner core metal 2 and the intermediate core metal 3 are placed.

Specifically, the bending mold 5 rotates and moves while radially holding the first pipe 101 and the second pipe 102 together with the inner core metal 2 and the intermediate core metal 3, to thereby bend the first pipe 101 and the second pipe 102. The bending mold 5 includes a rotating portion 51, a first clamping portion 52, a slider 53, and a forwarding portion 54.

The rotating portion 51 is placed to radially overlap with the bending portion of the double pipe 110. The rotating portion 51 is configured to rotate about a rotation axis P with a chuck portion 51A pressed against an outer-circumferential surface of the double pipe 110. The rotation axis P of the rotating portion 51 is parallel to the first pivot axis L1 of the first inner movable portion 22 (see, FIG. 2A).

The rotating portion 51 is configured to press an inner surface of the first pipe 101 against the first inner movable portion 22 and the second inner movable portion 23, and also to press an inner surface of the second pipe 102 against the first intermediate movable portion 32 and the second intermediate movable portion 33.

The first clamping portion 52 is located opposite to the rotating portion 51 across the double pipe 110. The first clamping portion 52 is configured to hold the double pipe 110 between the first clamping portion 52 and the chuck portion 51A of the rotating portion 51. The first clamping portion 52 pivots about the rotation axis P of the rotating portion 51 as the rotating portion 51 rotates.

The slider 53 is placed adjacent to the rotating portion 51. In a bending process, the slider 53 slides along an outer-circumference surface of the straight portion of the double pipe 110, to thereby provide a guiding function to forward the double pipe 110 along a rotation direction of the rotating portion 51.

The forwarding portion 54 is located at a position opposite to the slider 53 across the double pipe 110 and adjacent to the first clamping portion 52. The forwarding portion 54 is configured to move along the central axis of the double pipe 110 while pressing the straight portion of the double pipe 110 in the radial direction. The forwarding portion 54 forwards the double pipe 110 toward the rotating portion 51 while pressing the double pipe 110 against the slider 53.

<Re-Bending Mold>

A re-bending mold 6 is configured to further bend (or re-bend) the second pipe 102 of the double pipe 110, which is bent or has been bent with the bending mold 5. The re-bending mold 6 includes a second clamping portion 61, a third clamping portion 62, and a pressurizer 63.

The second clamping portion 61 and the third clamping portion 62 hold the double pipe 110 therebetween in the radial direction. Specifically, the third clamping portion 62 moves so as to press the double pipe 110 against the second clamping portion 61 fixed to the double pipe 110, thereby fixing the double pipe 110 between the second clamping portion 61 and the third clamping portion 62.

The pressurizer 63 presses itself against the outer-circumferential surface of the double pipe 110, to thereby externally apply pressure to the double pipe 110 in the radial direction. As a result, the second pipe 102 of the double pipe 110 is bent in a manner to rotate about the fulcrum.

<Controller>

The controller 8 is configured with, for example, a computer that comprises a processor, a storage medium, such as a RAM, a ROM or the like, an inputter, and an outputter. The controller 8 executes a program stored in advance, to thereby control respective operations of the bending mold 5 and the re-bending mold 6.

The controller 8 is configured to execute a first bending process, a second bending process, a supplemental re-bending process, and a re-bending process. In a method of manufacturing a bent pipe to be described below, the first bending process corresponds to first bending; the second bending process corresponds to second bending; the supplemental re-bending process corresponds to supplemental re-bending; and the re-bending process corresponds to re-bending.

[1-2. Manufacturing Method]

Figure 3:
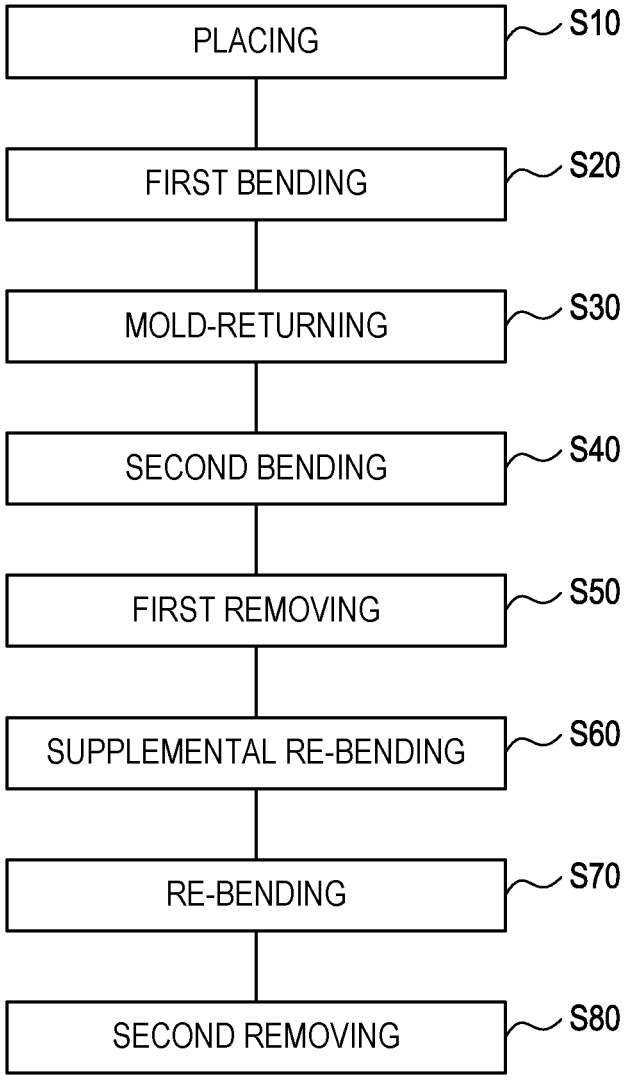
FIG. 3 is a flow chart of a method of manufacturing a bent pipe according to the embodiment.

Hereinafter, descriptions are given to the method of manufacturing a bent pipe using the manufacturing device 1 for a bent pipe shown in FIG. 1. As shown in FIG. 3, the method of manufacturing a bent pipe according to the present embodiment comprises placing S10, first bending S20, mold-returning S30, second bending S40, first removing S50, supplemental re-bending S60, re-bending S70, and second removing S80.

<Placing>

In the placing S10, the inner core metal 2 is placed inside the first pipe 101 and the intermediate core metal 3 is placed between the first pipe 101 and the second pipe 102 as shown in FIG. 1. Specifically, the double pipe 110 is introduced from the second end 112 thereof in the axial direction toward the inner core metal 2 and the intermediate core metal 3 held between the rotating portion 51 and the first clamping portion 52 of the bending mold 5.

In this placing, the inner core metal 2 is held such that the respective central axes of the inner core metal main body 21, the first inner movable portion 22, and the second inner movable portion 23 coincide with one another. Similarly, the intermediate core metal 3 is held such that the respective central axes of the intermediate core metal main body 31, the first intermediate movable portion 32, and the second intermediate movable portion 33 coincide with one another.

Furthermore, the first inner movable portion 22 is placed such that at least a portion thereof overlaps with the intermediate core metal 3 in the radial direction of the first pipe 101. The second inner movable portion 23 is placed not to overlap with the intermediate core metal 3 in the radial direction of the first pipe 101.

<First Bending>

In the first bending S20, the first pipe 101 and the second pipe 102 are bent with the bending mold 5 in a first direction D1 in a first area R1 of the double pipe 110 where the inner core metal 2 and the intermediate core metal 3 are placed.

Figure 4A:
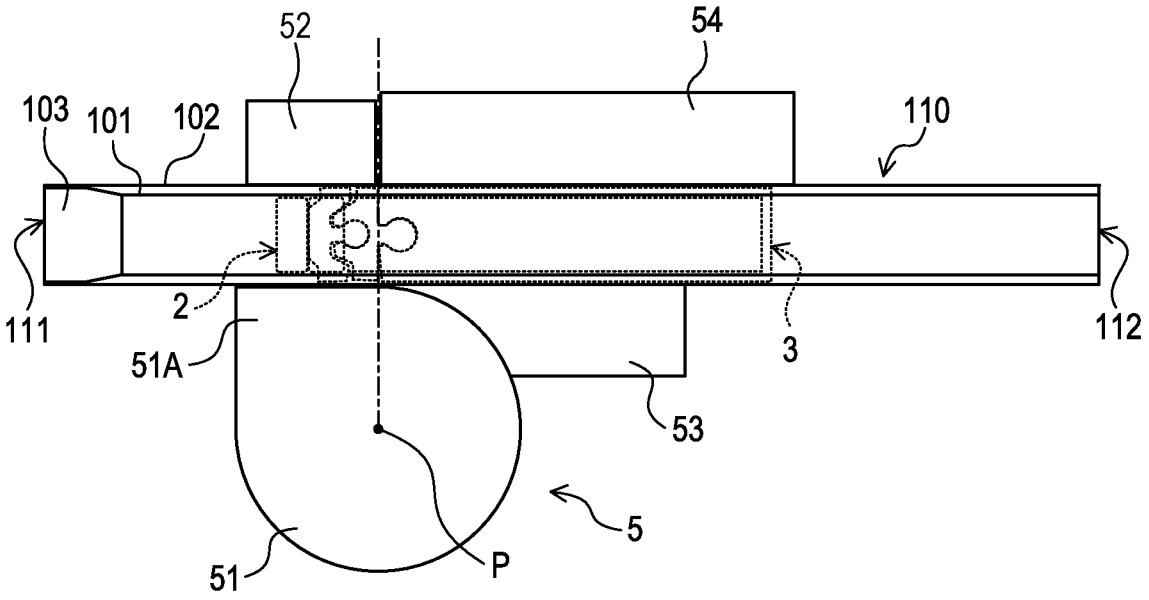
FIG. 4A is a schematic diagram explaining a process of the method of manufacturing a bent pipe of FIG. 3.

Specifically, as shown in FIG. 4A, the first clamping portion 52 and the forwarding portion 54 first apply pressure, in the radial direction, to the double pipe 110 that contains the inner core metal 2 and the intermediate core metal 3 therein. As a result, the double pipe 110 slides toward the rotating portion 51 in the radial direction together with the inner core metal 2 and the intermediate core metal 3. The double pipe 110 is pressed against the chuck portion 51A of the rotating portion 51 by the first clamping portion 52 and is also pressed against the slider 53 by the forwarding portion 54.

Figure 4B:
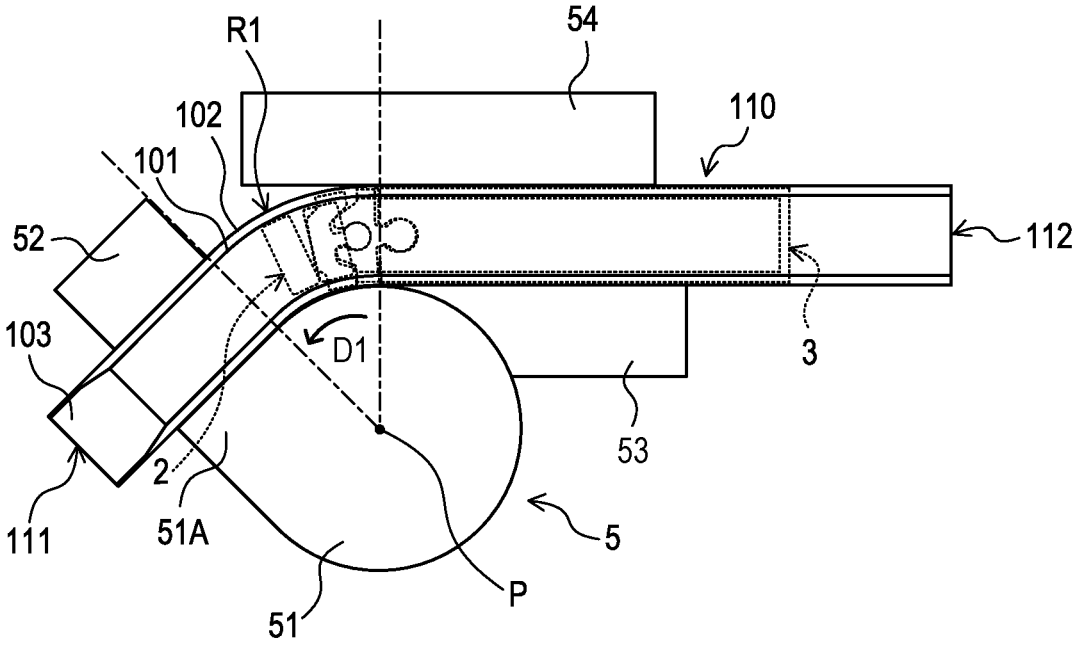
FIG. 4B is a schematic diagram explaining a process subsequent to the process of FIG. 4A.

Subsequently, as shown in FIG. 4B, the rotating portion 51 rotates in a direction in which the chuck portion 51A is spaced apart from the slider 53 (that is, toward the first end 111) and the forwarding portion 54 slides in a direction to follow the first clamping portion 52. The rotation direction of the rotating portion 51 coincides with the first direction D1.

Due to the above-described rotation and sliding, the chuck portion 51A and the first clamping portion 52 slide on the outer-circumferential surface of the double pipe 110 toward the first end 111 while interposing the double pipe 110 therebetween. Consequently, a portion of the double pipe 110, which is interposed between the chuck portion MA and the first clamping portion 52, is plastically deformed to curve about the rotation axis P of the rotating portion 51.

The first inner movable portion 22 pivots with respect to the inner core metal main body 21 so as to follow the bending of the double pipe 110 resulting from the rotation of the rotating portion 51. Also, the second inner movable portion 23 pivots with respect to the first inner movable portion 22 so as to follow the bending of the double pipe 110.

Similarly, the first intermediate movable portion 32 pivots with respect to the intermediate core metal main body 31 so as to follow the bending of the double pipe 110 resulting from the rotation of the rotating portion 51. Also, the second intermediate movable portion 33 pivots with respect to the first intermediate movable portion 32 so as to follow the bending of the double pipe 110.

The inner core metal main body 21 and the intermediate core metal main body 31 are held not to move during the bending. Accordingly, the double pipe 110 moves, extending in a movement direction of the first clamping portion 52, while sliding with respect to the inner core metal 2 and the intermediate core metal 3.

The first bending is performed in consideration of re-bending to be described later. Specifically, the double pipe 110 is bent at a bending angle smaller than a designed bending angle in the first area R1 of the bent pipe to be manufactured (in other words, a bending angle in the first area R1 of the double pipe 110, which has undergone all the processes). The bending angle in the first bending can be determined by practically measuring the gap between the first pipe 101 and the second pipe 102 after the bending.

<Mold-Returning>

In the mold-returning S30, the inner core metal 2, the intermediate core metal 3, and the bending mold 5 return to respective initial positions after the first bending S20.

Figure 5A:
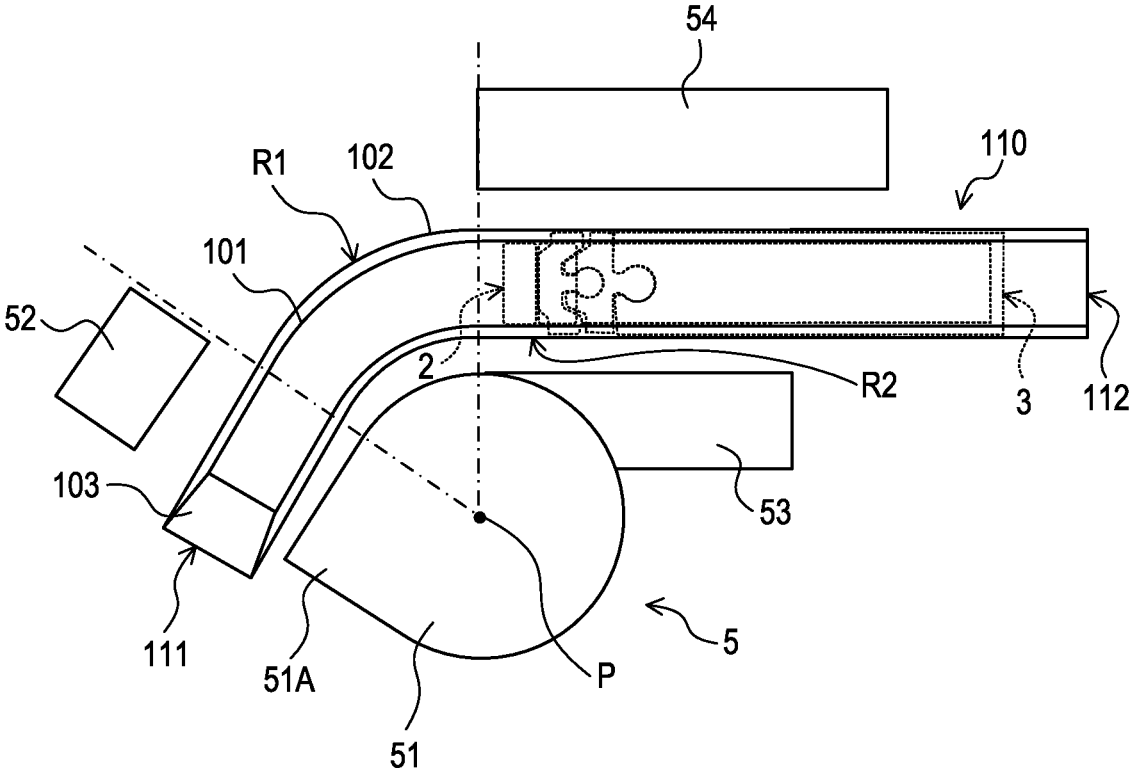
FIG. 5A is a schematic diagram explaining a process subsequent to the process of FIG. 4B.

First of all, as shown in FIG. 5A, the inner core metal 2 and the intermediate core metal 3 return back to respective positions that overlap with a second area R2, which is different from the first area R1. The second area R2 has more distance from the coupling portion 103 of the double pipe 110 than the first region R1 does. The second area R2 is located closer to the second end 112 than the first area R1 is.

As the inner core metal 2 and the intermediate core metal 3 return, the first pipe 101 is pulled by the inner core metal 2 and the intermediate core metal 3 and thus extends in the axial direction in the first area R1. Due to this, the first pipe 101 is further bent (or re-bent) in the first area R1. Consequently, the gap between the first pipe 101 and the second pipe 102 is reduced at an inner side of a bent portion in the first area R1.

After the inner core metal 2 and the intermediate core metal 3 are pulled out of the double pipe 110, the first clamping portion 52 and the forwarding portion 54 are spaced apart from the double pipe 110 in the radial direction. Also, the double pipe 110 is spaced apart from the rotating portion 51 and the slider 53. Furthermore, the forwarding portion 54 returns to its initial position.

Figure 5B:
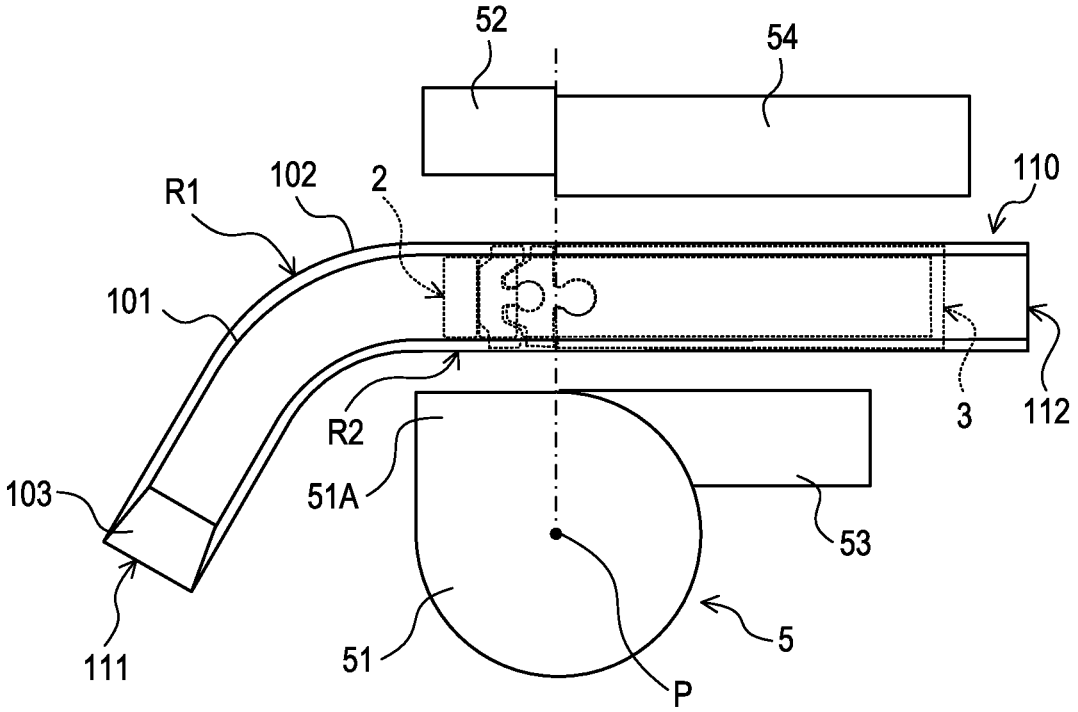
FIG. 5B is a schematic diagram explaining a process subsequent to the process of FIG. 5A.

Subsequently, as shown in FIG. 5B, after the rotating portion 51 and the first clamping portion 52 return to respective initial positions, the double pipe 110 is slid in the axial direction together with the inner core metal 2 and the intermediate core metal 3 to a position where the second area R2 of the double pipe 110 overlaps with the first clamping portion 52 in the radial direction.

<Second Bending>

In the second bending S40, after the first bending S20 and the mold-returning S30, the bending mold 5 bends the first pipe 101 and the second pipe 102 in a second direction D2 in the second area R2 of the double pipe 110 where the inner core metal 2 and the intermediate core metal 3 are placed.

Figure 6A:
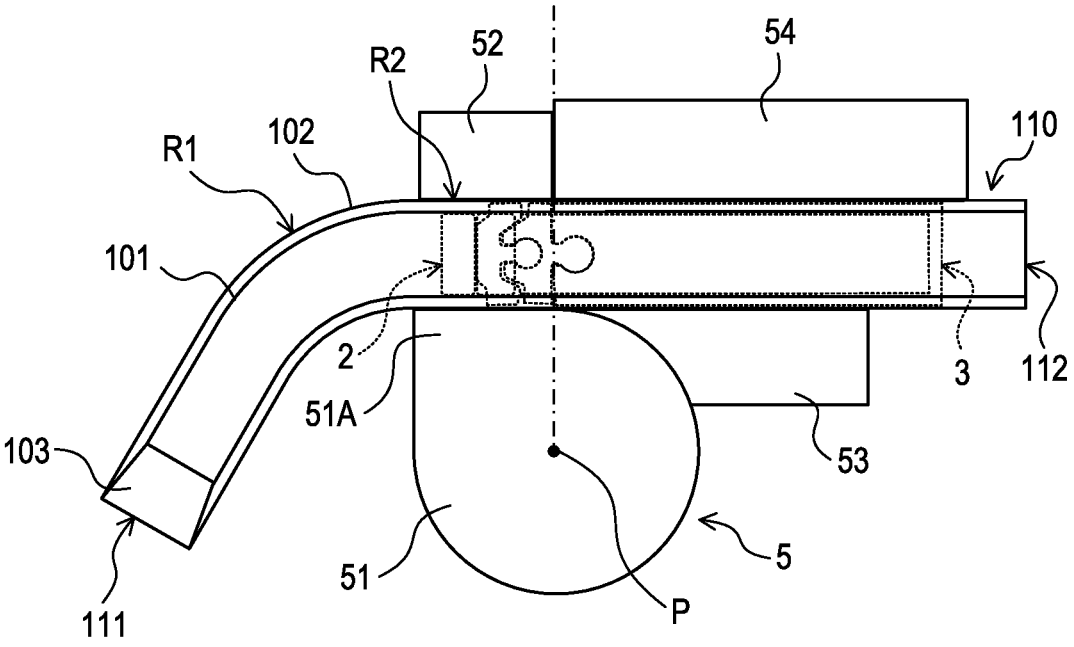
FIG. 6A is a schematic diagram explaining a process subsequent to the process of FIG. 5B.

Specifically, as shown in FIG. 6A, the first clamping portion 52 and the forwarding portion 54 first apply pressure, in the radial direction, to the double pipe 110 that contains the inner core metal 2 and the intermediate core metal 3 therein. The double pipe 110 is pressed against the chuck portion MA of the rotating portion 51 by the first clamping portion 52 and is also pressed against the slider 53 by the forwarding portion 54.

Figure 6B:
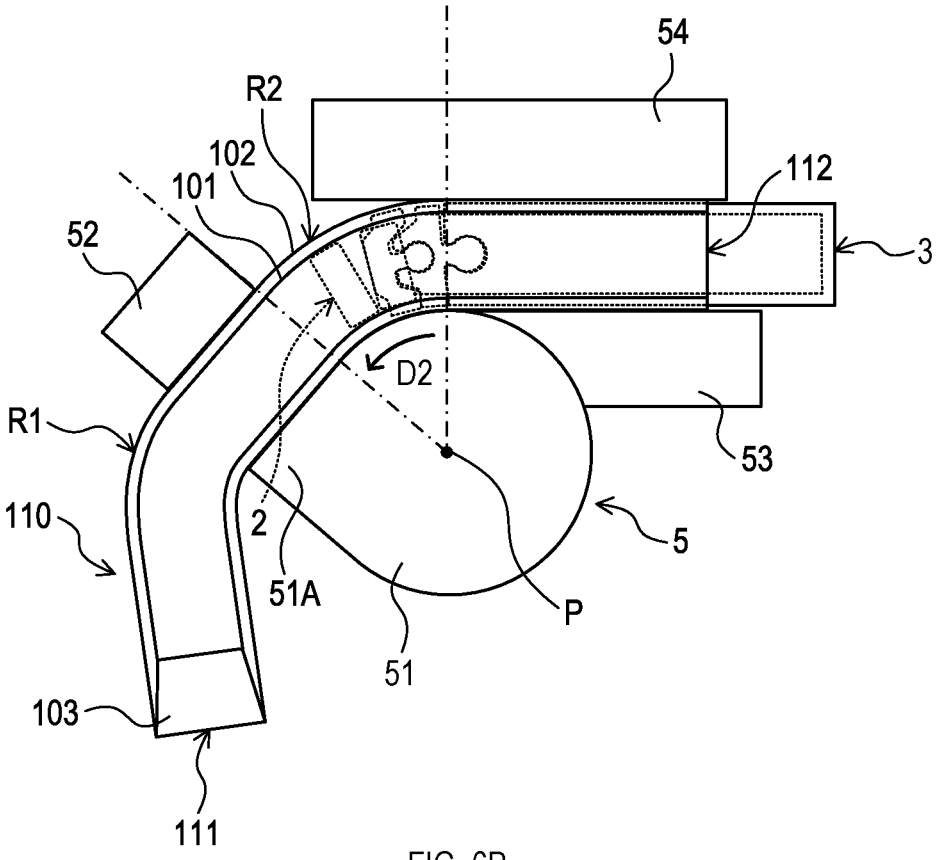
FIG. 6B is a schematic diagram explaining a process subsequent to the process of FIG. 6A.

Subsequently, as shown in FIG. 6B, the rotating portion 51 rotates in a direction in which the chuck portion 51A is spaced apart from the slider 53 (that is, toward the first end 111), and the forwarding portion 54 slides in a direction to follow the first clamping portion 52. The rotation direction of the rotating portion 51 coincides with the second direction D2. Due to this rotation and sliding, a portion of the double pipe 110, which is interposed between the chuck portion 51A and the first clamping portion 52, is plastically deformed to curve about the rotation axis P of the rotating portion 51.

As the portion of the double pipe 110 is deformed, the first pipe 101 is pulled in the axial direction due to sliding resistance on the inner core metal 2 and the intermediate core metal 3. Consequently, the first pipe 101 is bent in a manner to get close to an inner surface of the second pipe 102 at an inner side of a bent portion.

The second bending is performed in consideration of re-bending to be described later. Specifically, the double pipe 110 is bent at a bending angle smaller than a designed bending angle in the second area R2 of the bent pipe to be manufactured (in other words, a bending angle in the second area R2 of the double pipe 110, which has undergone all the processes).

The central axis of bending in the second direction D2 in the second bending S40 is the rotation axis P of the rotating portion 51, as with the central axis of bending in the first direction D1 in the first bending S20. Specifically, the central axis of bending in the first direction D1 in the first bending S20 and the central axis of bending in the second direction D2 in the second bending S40 are parallel to each other.

In other words, both the first area R1 and the second area R2 of the double pipe 110 are bent in a virtual plane perpendicular to the rotation axis P of the rotating portion 51. Furthermore, since the first direction D1 and the second direction D2 are the same direction, the double pipe 110 is arcuately bent through the first bending S20 and the second bending S40.

<First Removing>

In the first removing S50, the double pipe 110 is removed from the inner core metal 2, the intermediate core metal 3, and the bending mold 5 after the bending.

Figure 7A:
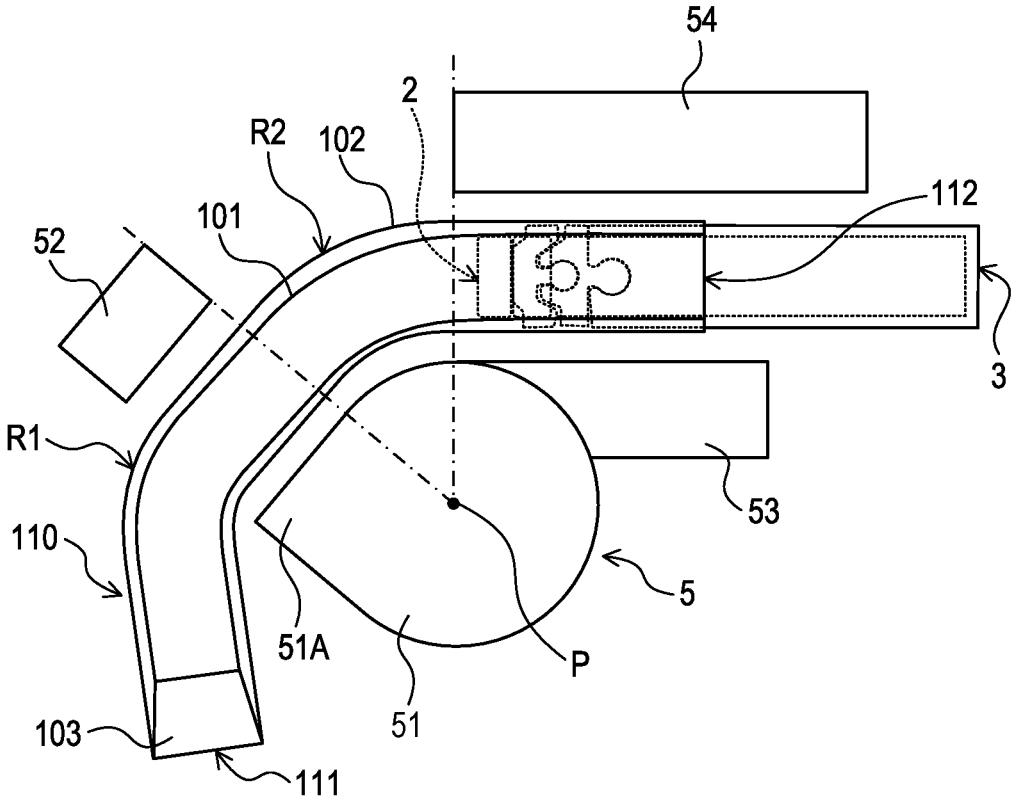
FIG. 7A is a schematic diagram explaining a process subsequent to the process of FIG. 6B.

Specifically, as shown in FIG. 7A, the inner core metal 2 and the intermediate core metal 3 first return back to respective positions that do not overlap with the second area R2 of the double pipe 110. As the inner core metal 2 and the intermediate core metal 3 return, the first pipe 101 is pulled by the inner core metal 2 and the intermediate core metal 3 and thus extends in the axial direction in the second area R2. This extension of the first pipe 101 causes the first pipe 101 to be further bent in the second area R2. As a result, the gap between the first pipe 101 and the second pipe 102 is reduced at the inner side of the bent portion in the second area R2.

After the inner core metal 2 and the intermediate core metal 3 are pulled out of the double pipe 110, the first clamping portion 52 and the forwarding portion 54 are spaced apart from the double pipe 110 in the radial direction. Also, the double pipe 110 is spaced apart from the rotating portion 51 and the slider 53. Furthermore, the forwarding portion 54 returns to its initial position.

Figure 7B:
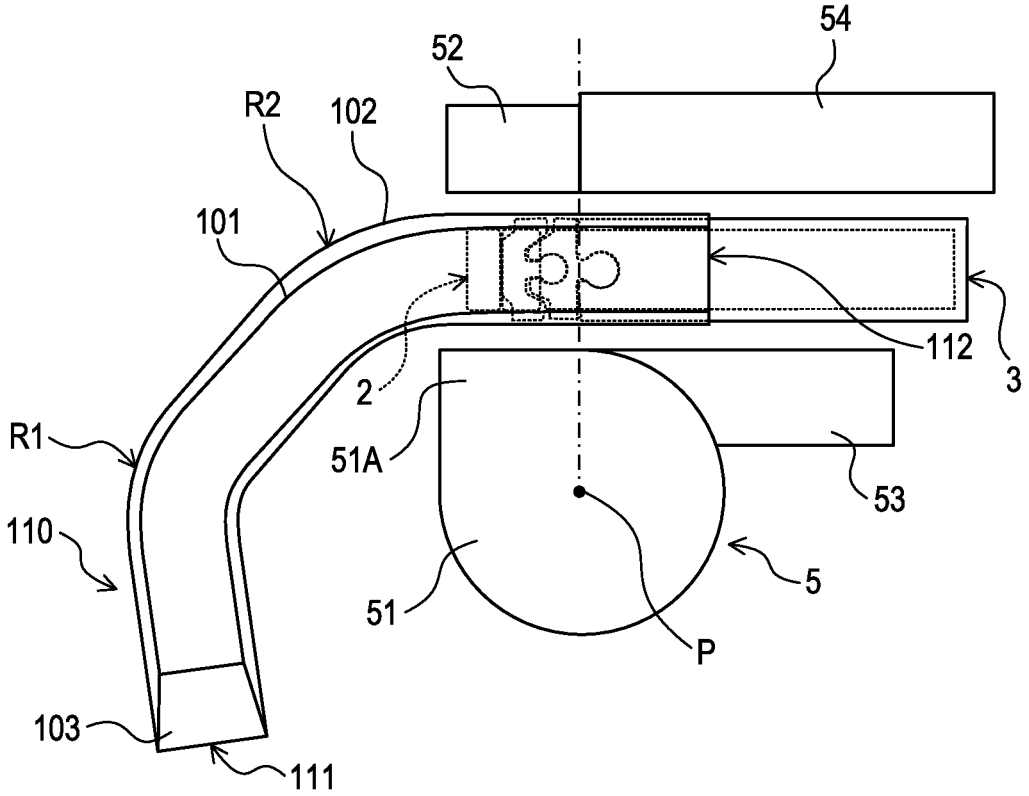
FIG. 7B is a schematic diagram explaining a process subsequent to the process of FIG. 7A.

Subsequently, as shown in FIG. 7B, after the rotating portion 51 and the first clamping portion 52 return to the respective initial positions, the double pipe 110 is removed from the inner core metal 2, the intermediate core metal 3, and the bending mold 5.

<Supplemental Re-Bending>

In the supplemental re-bending S60, the second pipe 102 is further bent (or re-bent) in the same direction as the first direction D1 in the first area R1 after the first bending S20 and the second bending S40.

Figure 8A:
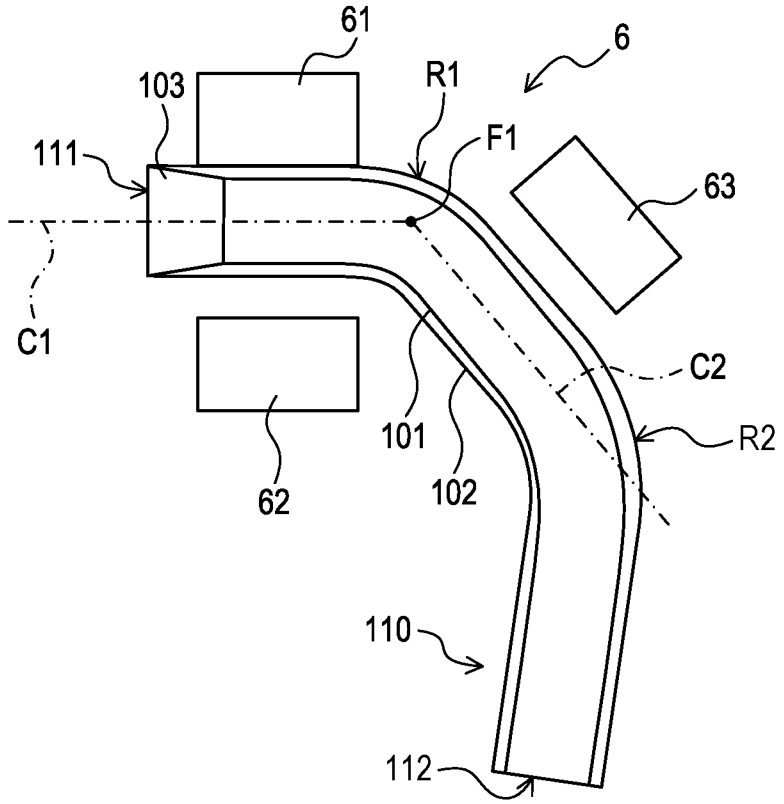
FIG. 8A is a schematic diagram explaining a process subsequent to the process of FIG. 7B.

Specifically, as shown in FIG. 8A, the double pipe 110, which has been removed from the bending mold 5 in the first removing S50, is first placed between the second clamping portion 61 and the third clamping portion 62 of the re-bending mold 6.

Figure 8B:
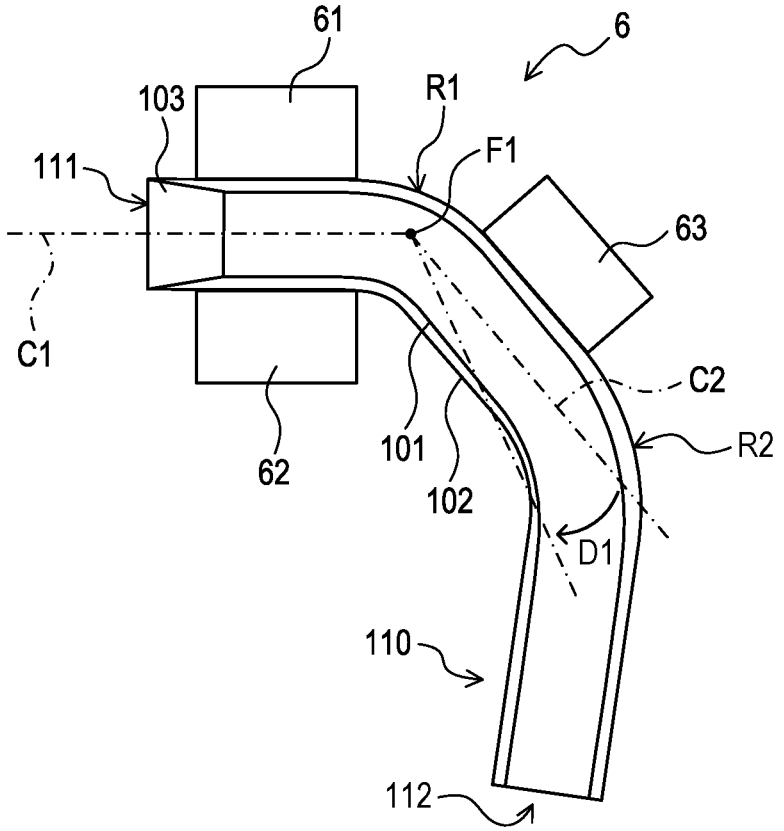
FIG. 8B is a schematic diagram explaining a process subsequent to the process of FIG. 8A.

Subsequently, as shown in FIG. 8B, the third clamping portion 62 moves toward the second clamping portion 61, to thereby hold, in the radial direction, a portion of the double pipe 110 located closer to the first end 111 than it is to the first area R1. With the double pipe 110 held between the second clamping portion 61 and the third clamping portion 62, the pressurizer 63 is radially pressed against a portion of the double pipe 110, located between the first area R1 and the second area R2, from respective outer sides of the bent portions in the first area R1 and the second area R2.

Consequently, the second pipe 102 rotates about a first fulcrum F1 included in the first area R1, whereby only the second pipe 102 is bent in the first direction D1. The first fulcrum F1 is an intersection between a first central axis C1 of the second pipe 102 and a second central axis C2 of the second pipe 102. Specifically, the first central axis C1 runs through a portion of the second pipe 102 located closer to the first end 111 than it is to the first area R1. The second central axis C2 runs through a portion of the second pipe 102 between the first area R1 and the second area R2.

In the supplemental re-bending, the inner core metal 2 and the intermediate core metal 3 are not placed in the double pipe 110 and therefore, the first pipe 101 is not bent while the second pipe 102 is re-bent or being re-bent. Furthermore, a re-bending angle of the second pipe 102 is set such that the bending angle of the first pipe 101 and the bending angle of the second pipe 102 are substantially the same in the first area R1 (in other words, respective gaps between the first pipe 101 and the second pipe 102 at the inner side and the outer side of the bent portion are substantially equal to each other).

<Re-Bending>

In the re-bending S70, the second pipe 102 is further bent (or re-bent) in the same direction as the second direction D2 in the second area R2 after the second bending S40 and the supplemental re-bending S60. The re-bending S70 may be performed before the supplemental re-bending S60.

Figure 9A:
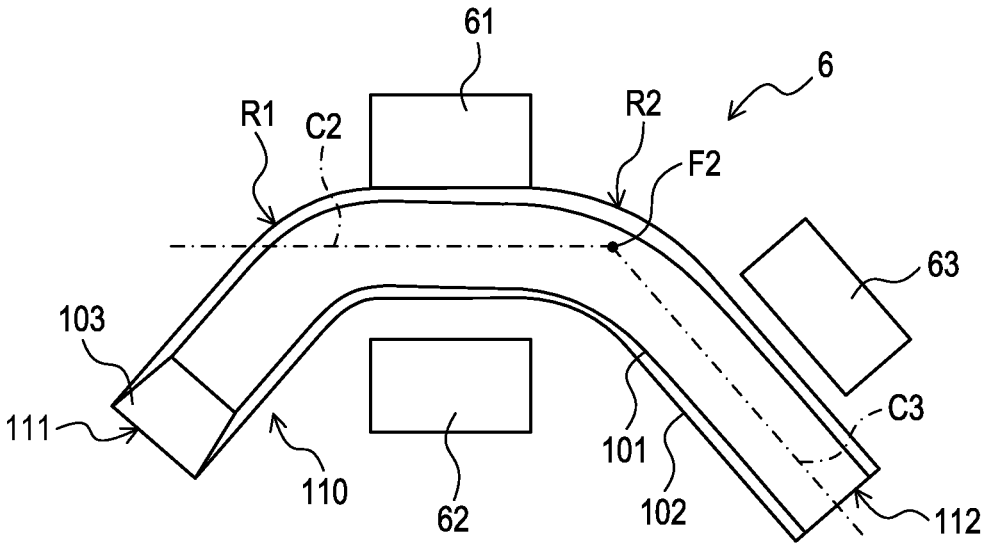
FIG. 9A is a schematic diagram explaining a process subsequent to the process of FIG. 8B.

Specifically, as shown in FIG. 9A, an orientation of the double pipe 110, which has been further bent in the first area R1, is first changed so as to re-place the double pipe 110 between the second clamping portion 61 and the third clamping portion 62 of the re-bending mold 6.

Figure 9B:
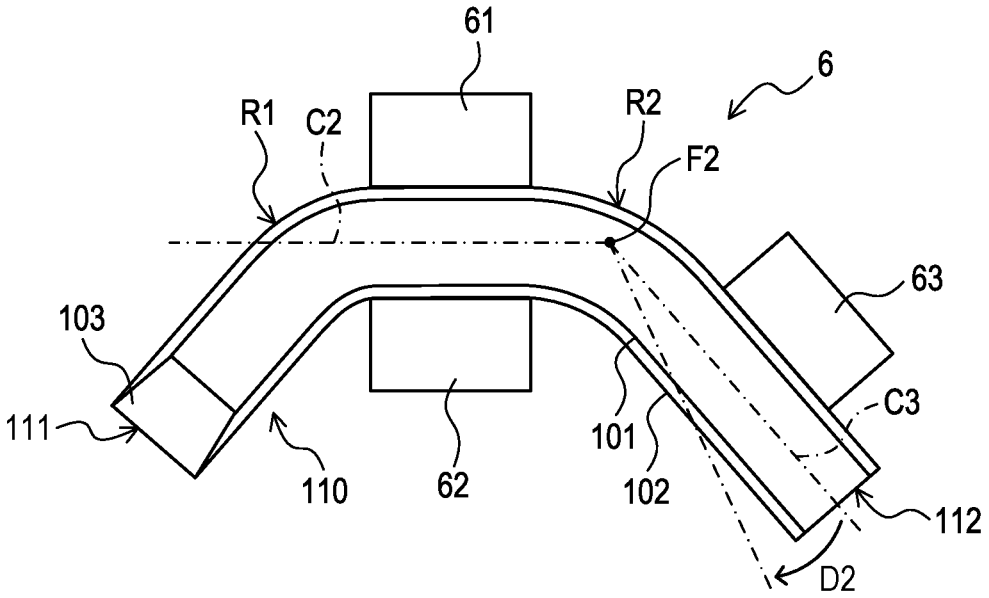
FIG. 9B is a schematic diagram explaining a process subsequent to the process of FIG. 9A.

Subsequently, as shown in FIG. 9B, the third clamping portion 62 moves toward the second clamping portion 61, to thereby hold, in the radial direction, the portion of the double pipe 110 between the first area R1 and the second area R2. With the double pipe 110 held between the second clamping portion 61 and the third clamping portion 62, the pressurizer 63 is radially pressed against a portion of the double pipe 110, located closer to the second end 112 than it is to the second area R2, from the respective outer sides of the bent portions in the first area R1 and the second area R2.

Consequently, the second pipe 102 rotates about a second fulcrum F2 included in the second area R2 and is thus bent in the second direction D2. The second fulcrum F2 is an intersection between the second central axis C2 of the second pipe 102 and a third central axis C3 of the second pipe 102. Specifically, the second central axis C2 runs through the portion of the second pipe 102 between the first area R1 and the second area R2. The third central axis C3 runs through a portion of the second pipe 102 located closer to the second end 112 than it is to the second area R2.

In the re-bending, the inner core metal 2 and the intermediate core metal 3 are not placed in the double pipe 110 and therefore, the first pipe 101 is not bent as in the supplemental re-bending S60. Furthermore, a re-bending angle of the second pipe 102 is set such that the bending angle of the first pipe 101 and the bending angle of the second pipe 102 are substantially equal to each other in the second area R2.

<Second Removing>

The second removing S80 removes the double pipe 110 from the re-bending mold 6 after the supplemental re-bending S60 and the re-bending S70.

[1-3. Effects]

The above-detailed embodiment can bring effects to be described below.

(1a) In the second area R2 distanced from the coupling portion 103, the second pipe 102 is re-bent so as to follow bending of the first pipe 101 caused due to the inner core metal 2 and the intermediate core metal 3 being pulled out or having been pulled out after the second bending. Thus, it is possible to bend the double pipe 110 multiple times while maintaining the gap between the first pipe 101 and the second pipe 102.

(1b) The supplemental re-bending enables to compensate for reduction of the gap between the first pipe 101 and the second pipe 102 in the first area R1.

(1c) With the re-bending mold 6, it is possible to re-bend the double pipe 110, with the double pipe 110 being placed in a specific orientation, after completion of the first bending and the second bending. This consequently facilitates compensation for the gap between the first pipe 101 and the second pipe 102.

(1d) The re-bending mold 6 re-bends a portion of the second pipe 102 corresponding to a portion of the first pipe 101 that is or has been greatly deformed. Thus, it is possible to efficiently leave the gap between the first pipe 101 and the second pipe 102.

(1e) In the double pipe 110 in which the first direction D1 and the second direction D2 are the same direction (that is, the double pipe 110 is bent multiple times in the same direction), it is possible to efficiently compensate for reduction of the gap between the first pipe 101 and the second pipe 102.

2. Second Embodiment

[2-1. Configuration]

Figure 10:
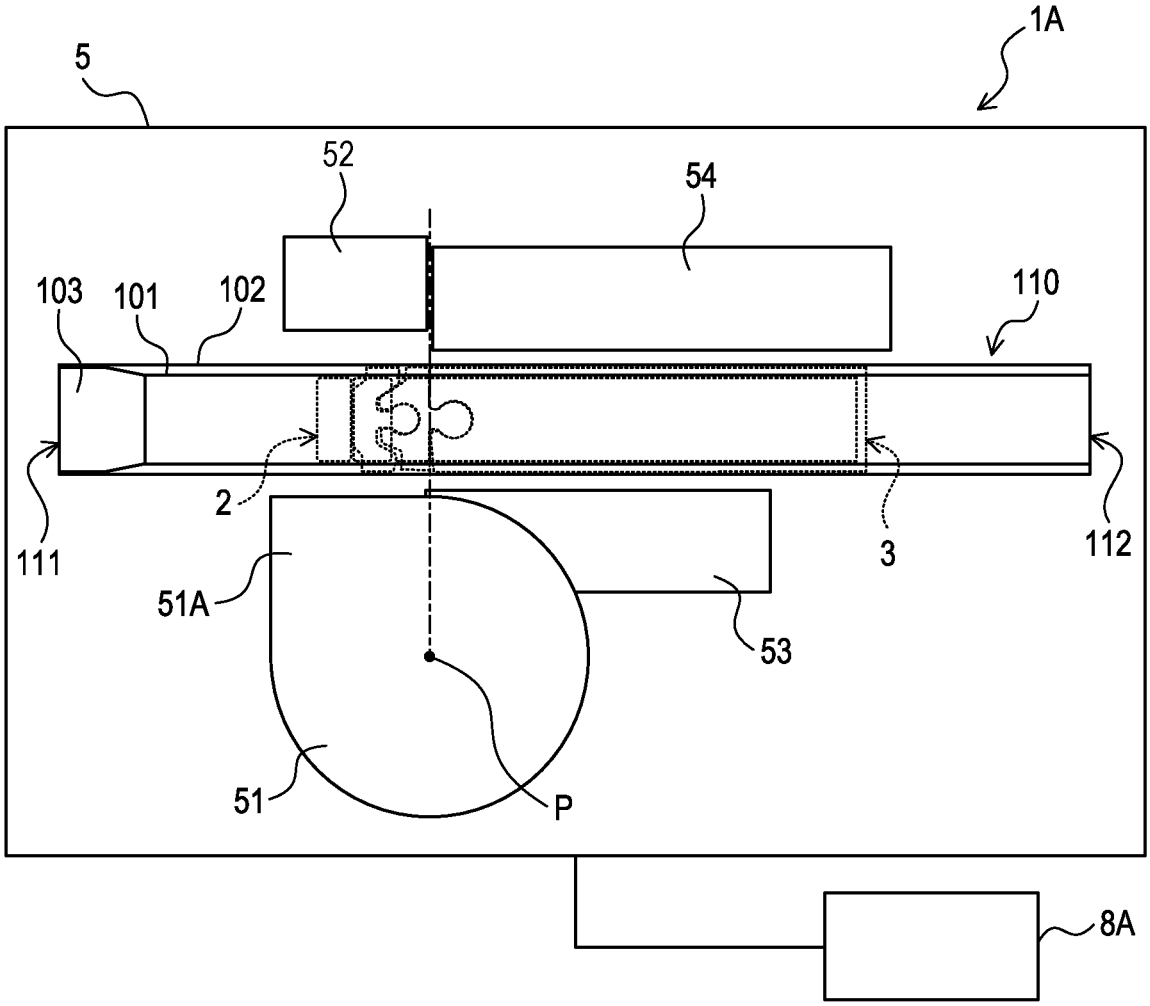
FIG. 10 is a schematic diagram of a manufacturing device for a bent pipe according to an embodiment different from the embodiment of FIG. 1.

A manufacturing device 1A for a bent pipe (hereinafter, simply referred to as "manufacturing device 1A" as well) shown in FIG. 10 is a device for obtaining a bent pipe by bending a straight pipe.

The manufacturing device 1A of the present embodiment comprises the inner core metal 2, the intermediate core metal 3, the bending mold 5, and a controller 8A. The inner core metal 2, the intermediate core metal 3, and the bending mold 5 in the manufacturing device 1A are identical with the inner core metal 2, the intermediate core metal 3, and the bending mold 5 in the manufacturing device 1 of FIG. 1.

<Controller>

The controller 8A is configured with, for example, a computer that comprises a processor, a storage medium, such as a RAM, a ROM, or the like, an inputter, and an outputter. The controller 8A executes a program stored in advance, to thereby control the operation of the bending mold 5.

The controller 8A is configured to execute the first bending process, the second bending process, the supplemental re-bending process, and the bending process. In the present embodiment, the controller 8A executes the re-bending process and the supplemental re-bending process with the bending mold 5.

[2-2. Manufacturing Method]

Figure 11:
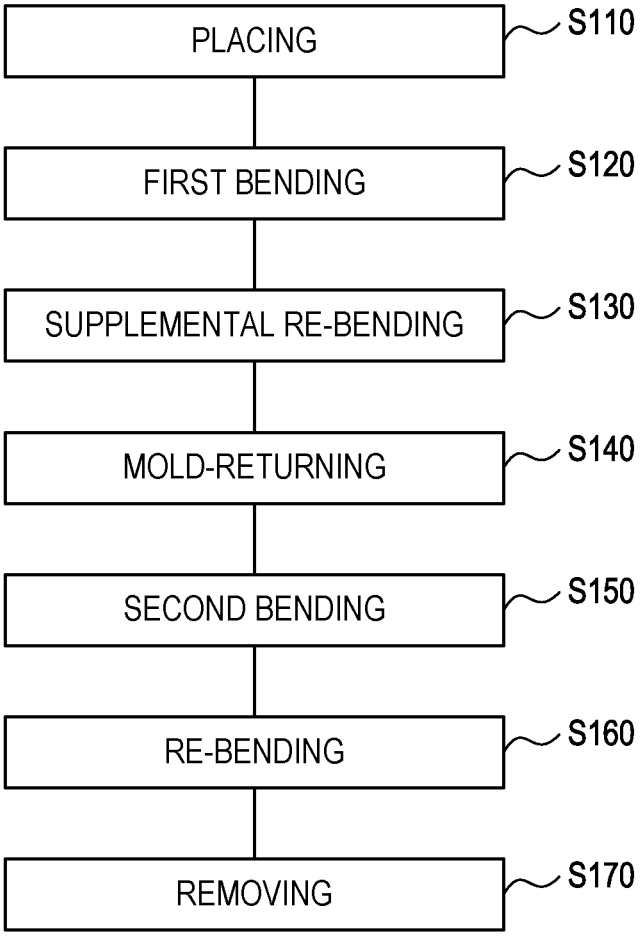
FIG. 11 is a flow chart of a method of manufacturing a bent pipe according to an embodiment different from the embodiment of FIG. 3.

Hereinafter, descriptions are given to a method of manufacturing a bent pipe using the manufacturing device 1A for a bent pipe shown in FIG. 10. As shown in FIG. 11, the method of manufacturing a bent pipe according to the present embodiment comprises placing S110, first bending S120, supplemental re-bending S130, mold-returning S140, second bending S150, re-bending S160, and removing S170.

<Placing>

The placing S110 is identical with the placing S10 in the method of manufacturing a bent pipe of FIG. 3. Thus, a description will be omitted.

<First Bending>

The first bending S120 is identical with the first bending S20 in the method of manufacturing a bent pipe of FIG. 3. Thus, a description will be omitted (see, FIGS. 4A and 4B).

<Supplemental Re-Bending>

In the supplemental re-bending S130, the bending mold 5 is used to further bend the second pipe 102 in the same direction as the first direction D1 in the first area R1 after the first bending S120, but before the second bending S150.

Figure 12A:
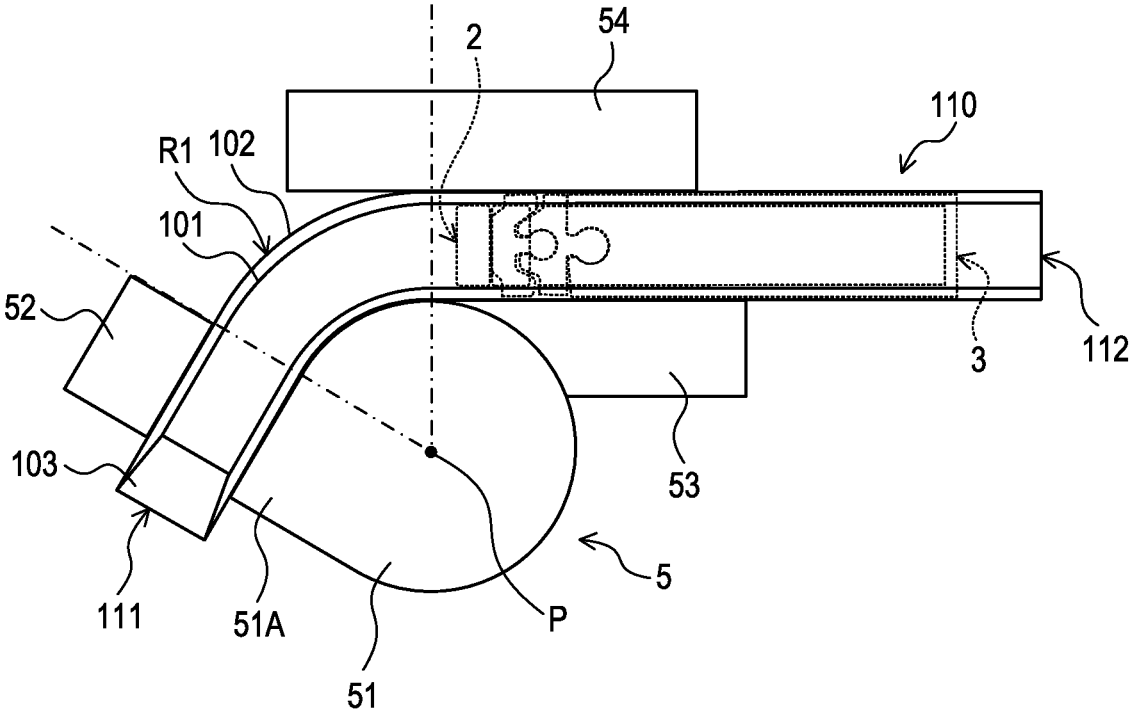
FIG. 12A is a schematic diagram explaining a process of the method of manufacturing a bent pipe of FIG. 11.

Specifically, as shown in FIG. 12A, with the double pipe 110 held by the rotating portion 51, the first clamping portion 52, the slider 53, and the forwarding portion 54, the inner core metal 2 and the intermediate core metal 3 first return to respective positions that do not overlap with the first area R1.

As the inner core metal 2 and the intermediate core metal 3 return, the first pipe 101 is pulled by the inner core metal 2 and the intermediate core metal 3 and thus extends in the axial direction in the first area R1. Due to this, the first pipe 101 is re-bent in the first area R1. Consequently, the gap between the first pipe 101 and the second pipe 102 is reduced in the first area R1.

Figure 12B:
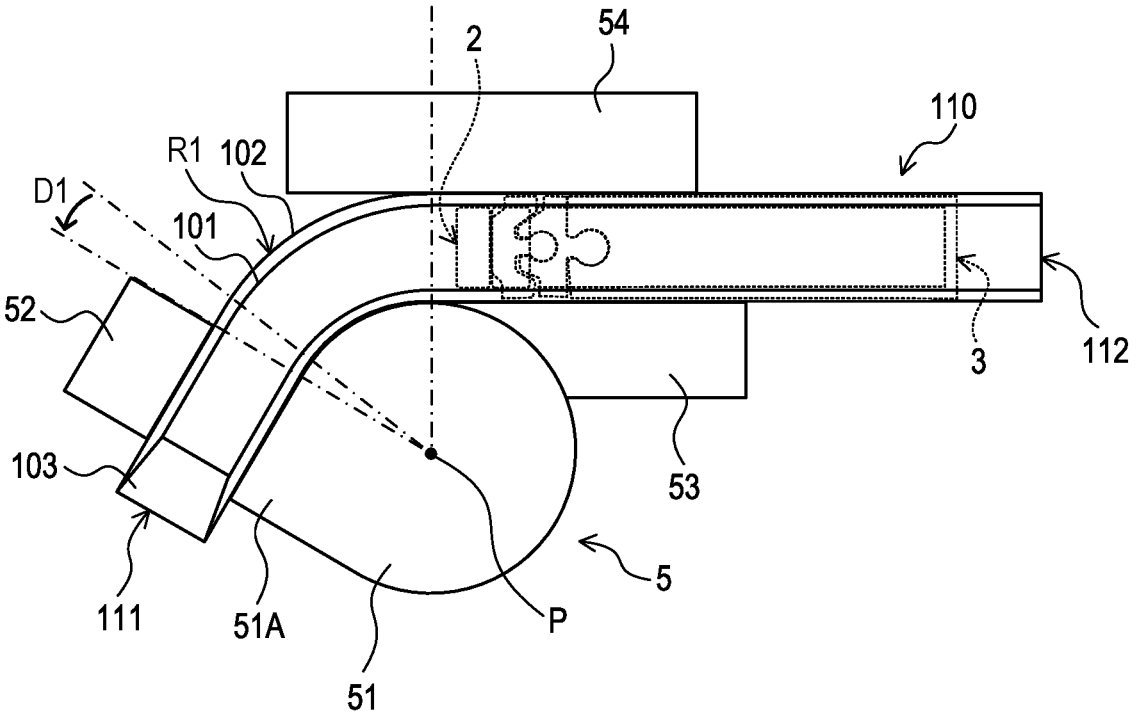
FIG. 12B is a schematic diagram explaining a process subsequent to the process of FIG. 12A.

Subsequently, as shown in FIG. 12B, the rotating portion 51 rotates in the first direction D1 with the chuck portion 51A and the first clamping portion 52 interposing therebetween a portion of the double pipe 110 located closer to the first end 111 than it is to the first area R1. Since the inner core metal 2 and the intermediate core metal 3 are not placed in the first area R1, only the second pipe 102 is bent in the first direction D1.

Accordingly, the gap between the first pipe 101 and the second pipe 102 is adjusted in the first area R1. In other words, the bending angle of the first pipe 101 and the bending angle of the second pipe 102 are adjusted to be approximately equal to each other in the first area R1.

<Mold-Returning>

In the mold-returning S140, the inner core metal 2, the intermediate core metal 3, and the bending mold 5 return to the respective initial positions after the supplemental re-bending S130.

Figure 13A:
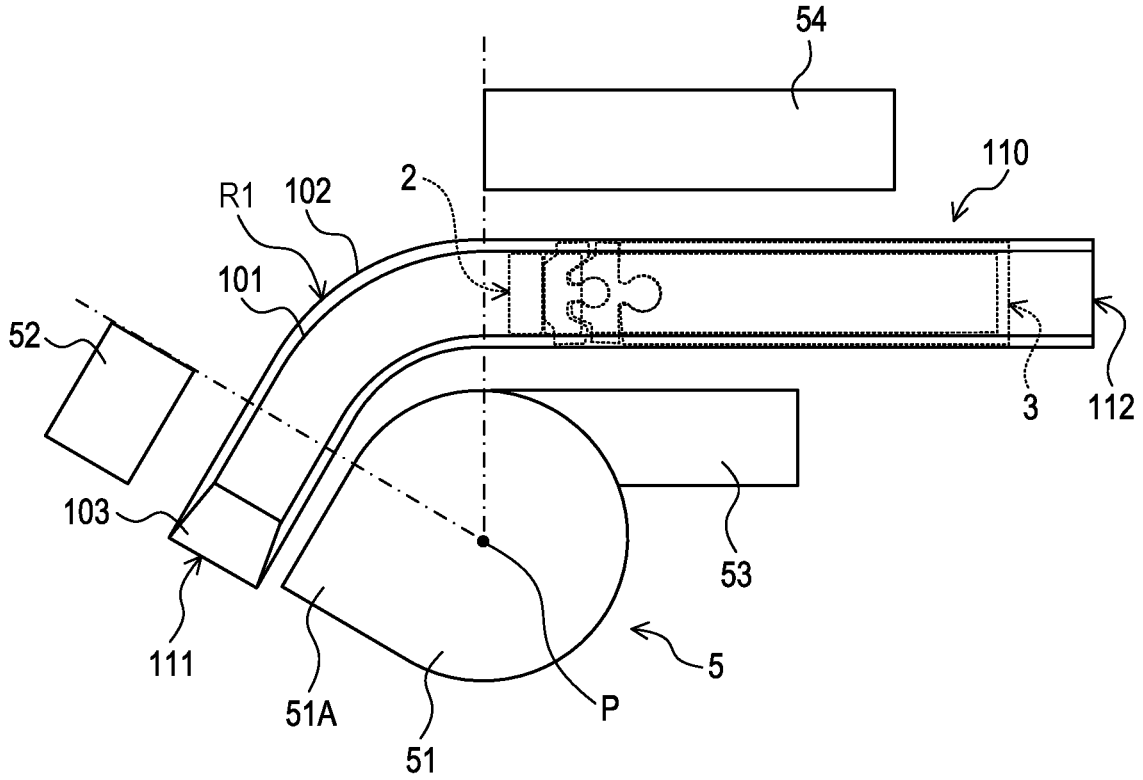
FIG. 13A is a schematic diagram explaining a process subsequent to the process of FIG. 12B.

Specifically, as shown in FIG. 13A, the first clamping portion 52 and the forwarding portion 54 are spaced apart from the double pipe 110 in the radial direction. Also, the double pipe 110 is spaced apart from the rotating portion 51 and the slider 53. Furthermore, the forwarding portion 54 returns to its initial position.

Subsequently, after the rotating portion 51 and the first clamping portion 52 return to the respective initial positions, the double pipe 110 is slid in the axial direction together with the inner core metal 2 and the intermediate core metal 3 to the position where the second area R2 of the double pipe 110 overlaps with the first clamping portion 52 in the radial direction (see, FIG. 5B).

<Second Bending>

The second bending S150 is identical with the second bending S40 in the method of manufacturing a bent pipe shown in FIG. 3. Thus, a description will be omitted (see, FIGS. 6A and 6B). In the second bending S150, the first pipe 101 is pulled in the axial direction due to sliding resistance on the inner core metal 2 and the intermediate core metal 3. Consequently, the first pipe 101 is bent in a manner to get close to an inner surface of the second pipe 102 at the inner side of the bent portion.

<Re-Bending>

In the re-bending S160, the second pipe 102 is further bent (or re-bent) in the same direction as the second direction D2 in the second area R2 after the second bending S150.

Figure 13B:
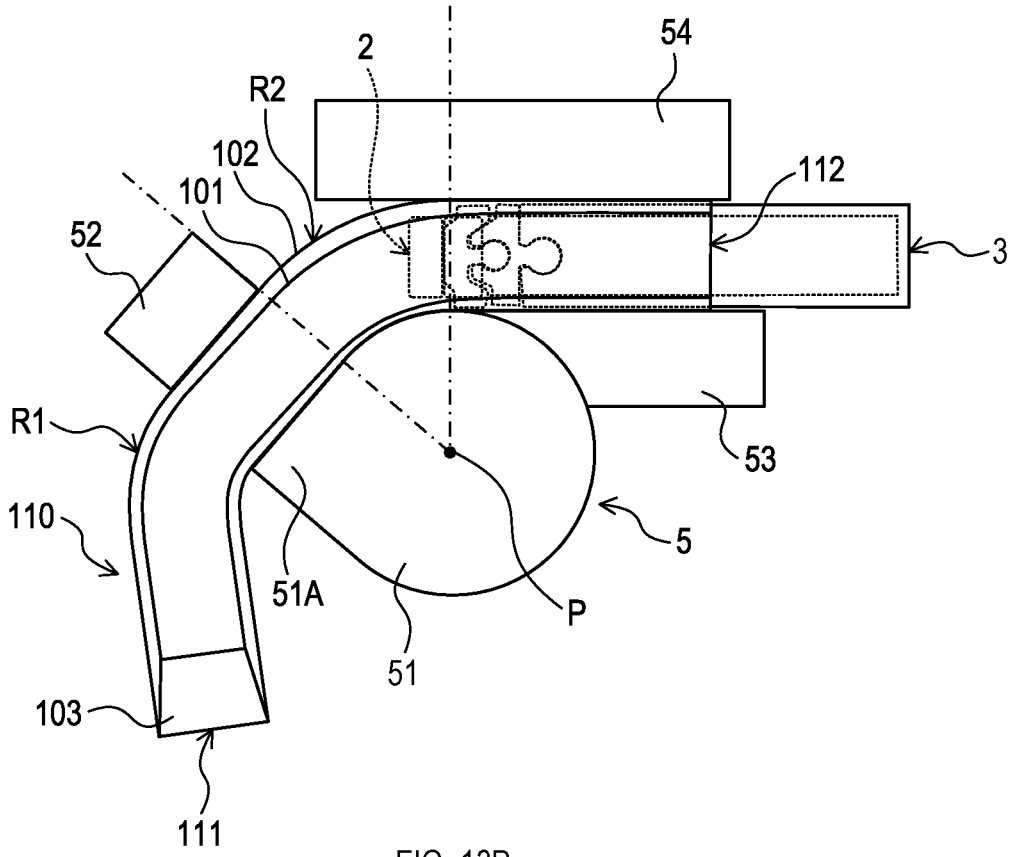
FIG. 13B is a schematic diagram explaining a process subsequent to the process of FIG. 13A.

Specifically, as shown in FIG. 13B, the inner core metal 2 and the intermediate core metal 3 first return to respective positions that do not overlap with the second area R2 with the double pipe 110 held by the rotating portion 51, the first clamping portion 52, the slider 53, and the forwarding portion 54.

As the inner core metal 2 and the intermediate core metal 3 return, the first pipe 101 is pulled by the inner core metal 2 and the intermediate core metal 3 and thus extends in the axial direction in the second area R2. Due to this, the first pipe 101 is re-bent in the second area R2. Consequently, the gap between the first pipe 101 and the second pipe 102 is reduced in the second area R2.

Figure 14A:
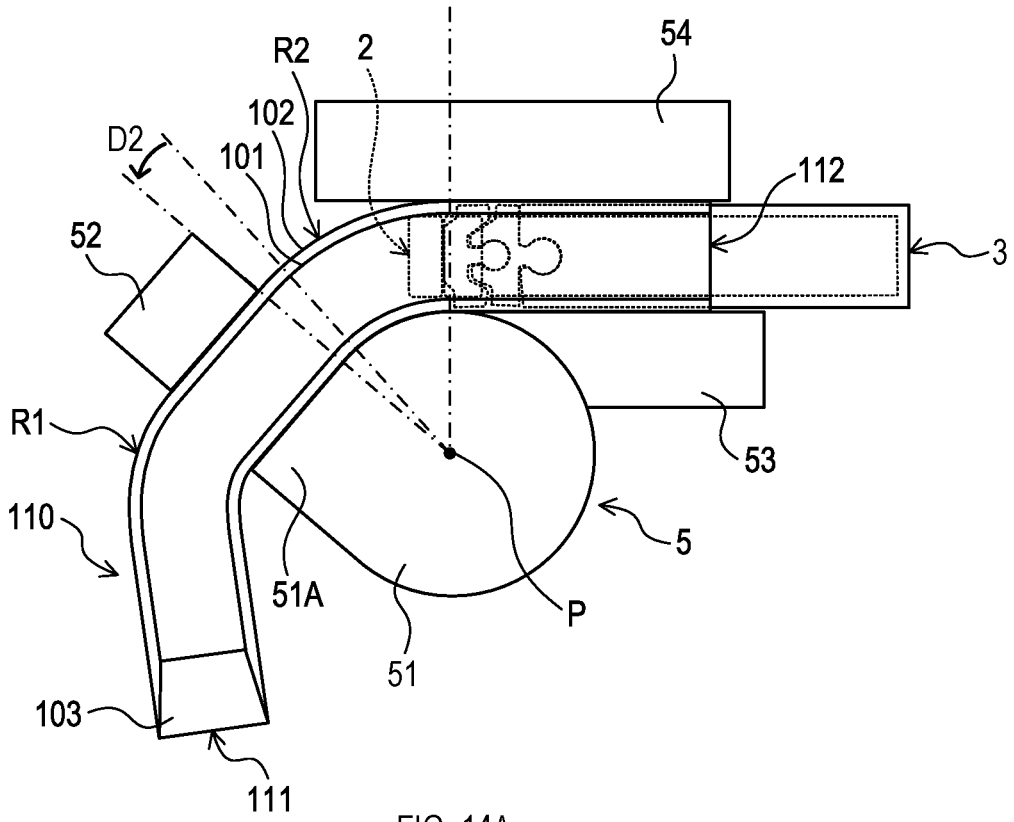
FIG. 14A is a schematic diagram explaining a process subsequent to the process of FIG. 13B.

Subsequently, as shown in FIG. 14A, the rotating portion 51 rotates in the second direction D2 with the chuck portion 51A and the first clamping portion 52 interposing therebetween a portion of the double pipe 110 located closer to the first area R1 than it is to the second area R2. Since the inner core metal 2 and the intermediate core metal 3 are not placed in the second area R2, only the second pipe 102 is bent in the second direction D2.

Accordingly, the gap between the first pipe 101 and the second pipe 102 is adjusted in the second area R2. In other words, the bending angle of the first pipe 101 and the bending angle of the second pipe 102 are adjusted to be approximately equal to each other in the second area R2.

<Removing>

In the removing S170, the double pipe 110, which has been bent and re-bent, is removed from the inner core metal 2, the intermediate core metal 3, and the bending mold 5.

Figure 14B:
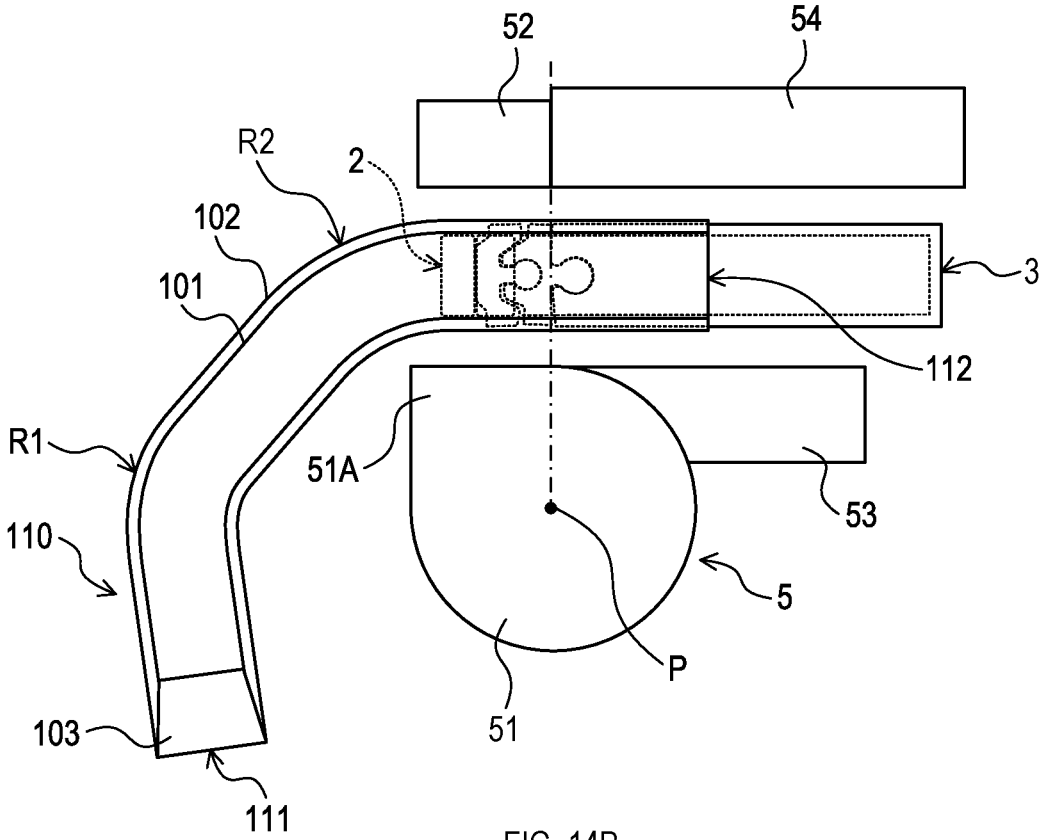
FIG. 14B is a schematic diagram explaining a process subsequent to the process of FIG. 14A.

Specifically, as shown in FIG. 14B, the first clamping portion 52 and the forwarding portion 54 are spaced apart from the double pipe 110 in the radial direction. Also, the double pipe 110 is spaced apart from the rotating portion 51 and the slider 53. Furthermore, the bending mold 5 returns to its initial position (that is, a position allowing the double pipe 110 to be introduced before the bending). Then, the double pipe 110 is removed from the inner core metal 2, the intermediate core metal 3, and the bending mold 5.

[2-3. Effects]

The above-detailed embodiment can bring effects to be described below.

(2a) The double pipe 110 can be re-bent while being placed in the bending mold 5. Thus, the manufacturing process of the bent pipe is reduced.

3. Other Embodiments

The embodiments of the present disclosure have been described above. However, the present disclosure is not limited to the embodiments described above and may take various forms.

(3a) In the manufacturing device for a bent pipe according to each embodiment described above, the first pipe is less affected by pulling out the inner core metal and the intermediate core metal, that is, undergoes less bending in the first area adjacent to the coupling portion of the double pipe. Thus, the controller may not necessarily execute the supplemental re-bending. In other words, the method of manufacturing a bent pipe according to each embodiment described above may not necessarily comprise the supplemental re-bending.

(3b) In the manufacturing device for a bent pipe according to each embodiment described above, the controller may execute the bending process three times or more. In other words, the method of manufacturing a bent pipe according to each embodiment described above may comprise three or more times of bending.

(3c) In the manufacturing device for a bent pipe and the method of manufacturing a bent pipe according to each embodiment described above, the bending direction of the double pipe is one example. For example, the first direction and the second direction may not necessarily be the same direction. Furthermore, the double pipe may be three-dimensionally bent.

(3d) In the manufacturing device for a bent pipe according to each embodiment described above, the controller may execute bending-back of the second pipe in which the second pipe is bent in a direction opposite to the bending direction of the first pipe in the first area and/or the second area. In other words, the method of manufacturing a bent pipe according to each embodiment described above may comprise bending-back the second pipe.

(3e) Functions achieved by a single component in the above-described embodiments may be distributed to components. Functions achieved by components may be integrated into a single component. Also, a part of a configuration in the above-described embodiments may be omitted. Further, at least a part of a configuration in the above-described embodiments may be added to or replaced with a configuration in other embodiments described above. Any mode included in the technical idea identified by the wordings in the claims are embodiments of the present disclosure.

What is claimed is:

1. A manufacturing device for a bent pipe by which the bent pipe is obtained by bending a double pipe provided with a first pipe, a second pipe containing the first pipe therein, and a coupling portion coupling the first pipe and the second pipe to each other, the manufacturing device comprising:

an inner core metal configured to be placed inside the first pipe;

an intermediate core metal configured to be placed between the first pipe and the second pipe;

a bending mold configured to bend the double pipe; and a controller configured to execute:

a first bending process in which the first pipe and the second pipe are bent in a first direction with the bending mold in a first area of the double pipe where the inner core metal and the intermediate core metal are placed;

a second bending process in which the first pipe and the second pipe are bent in a second direction with the bending mold after the first bending process, the second bending process being applied to a second area of the double pipe where the inner core metal and the intermediate core metal are placed, the second area having more distance from the coupling portion than the first area does; and a re-bending process in which the second pipe is bent in the same direction as the second direction in the second area after the second bending process.

2. The manufacturing device for a bent pipe according to claim 1, wherein the controller is configured to execute a supplemental re-bending process in which the second pipe is bent in the same direction as the first direction in the first area after the first bending process.

3. The manufacturing device for a bent pipe according to claim 2, wherein the controller is configured to execute the supplemental re-bending process after the second bending process.

4. The manufacturing device for a bent pipe according to claim 3, further comprising a re-bending mold configured to rotate the second pipe about a fulcrum included in the second area, to thereby bend the second pipe, wherein the controller is configured to bend the second pipe with the re-bending mold in the re-bending process.

5. The manufacturing device for a bent pipe according to claim 2, wherein the controller is configured to execute the supplemental re-bending process with the bending mold before the second bending process.

6. The manufacturing device for a bent pipe according to claim 1, wherein the first direction and the second direction are the same direction.

7. A method of manufacturing a bent pipe by which the bent pipe is obtained by bending a double pipe provided with a first pipe, a second pipe containing the first pipe therein, and a coupling portion coupling the first pipe and the second pipe to each other, the method comprising:

placing an inner core metal inside the first pipe and placing an intermediate core metal between the first pipe and the second pipe;

bending the first pipe and the second pipe in a first direction with a bending mold in a first area of the double pipe where the inner core metal and the intermediate core metal are placed;

bending the first pipe and the second pipe in a second direction with the bending mold after the bending in the first direction, the bending in the second direction being applied to a second area of the double pipe where the inner core metal and the intermediate core metal are placed, the second area having more distance from the coupling portion than the first area does; and re-bending the second pipe in the same direction as the second direction in the second area after the bending in the second direction.

* * * * *